US005327592A

United States Patent [19]

Stump

[11] Patent Number: 5,327,592

[45] Date of Patent: Jul. 12, 1994

[54] STATIONARY PATIENT LIFT

[76] Inventor: Floyd V. Stump, Box 567, 818 Schopke Rd., Plymouth, Fla. 32768

[21] Appl. No.: 72,442

[22] Filed: Jun. 7, 1993

[51] Int. Cl.[5] ..... A61G 7/10

[52] U.S. Cl. ..... 5/81.1; 5/89.1; 254/362

[58] Field of Search ..... 5/81.1–89.1; 212/159; 254/362

[56] References Cited

U.S. PATENT DOCUMENTS

| | | | |
|---|---|---|---|
| 4,125,908 | 4/1978 | Vail et al. | 5/83.1 |
| 4,202,064 | 5/1980 | Joergensen | 5/83.1 |
| 4,243,147 | 1/1981 | Twitchell et al. | 5/89.1 |
| 4,372,452 | 2/1983 | McCord | 5/85.1 |
| 4,944,056 | 7/1990 | Schroeder et al. | 5/88.1 |
| 5,158,188 | 10/1992 | Nordberg | 5/85.1 |

FOREIGN PATENT DOCUMENTS

| | | | |
|---|---|---|---|
| 2287211 | 5/1976 | France | 5/89.1 |

*Primary Examiner*—Alexander Grosz

[57] ABSTRACT

A stationary patient lift can be used by individuals in their own homes to lift disabled and elderly individuals living with them. The lift has an electric hoist/winch for lifting the patients from a bed to a chair or wheelchair and back again to the bed. The lift is fixed to the rafters of a house. A cable hangs down through the ceiling of the house and the electric hoist hangs from the cable just below the ceiling. A chain or strap hangs down from the hoist mechanism to a sling for supporting the patient.

6 Claims, 4 Drawing Sheets

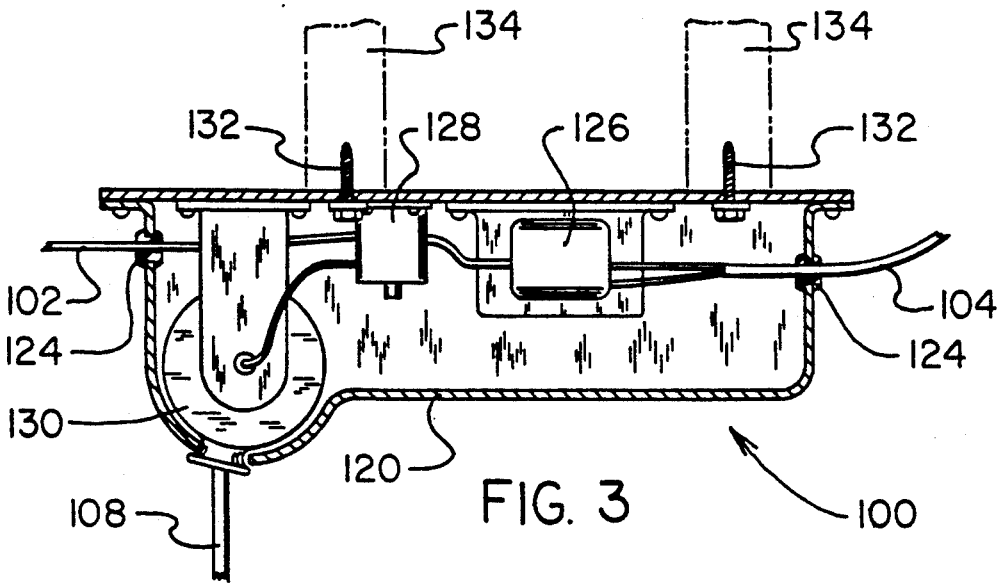
FIG. 3
FIG. 4
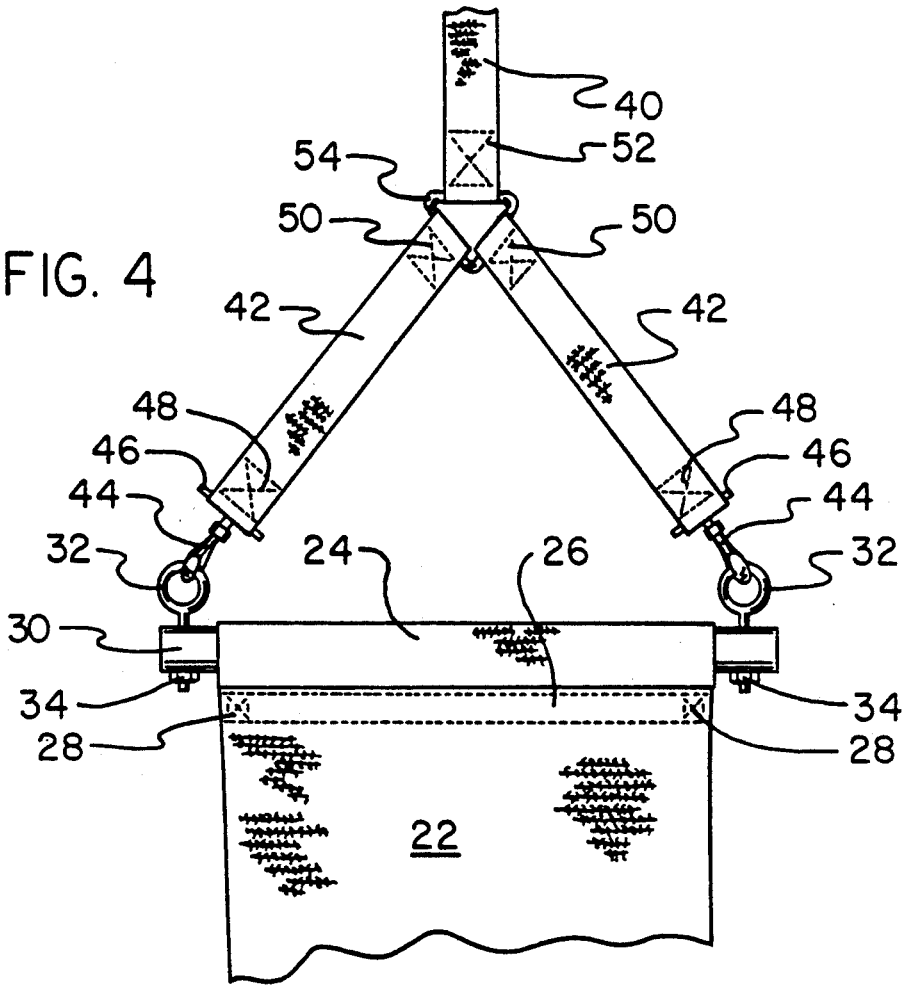

STATIONARY PATIENT LIFT

BACKGROUND OF THE INVENTION

1. Field of the Invention

The present invention relates generally to devices for helping to move patients from one position to another, and more particularly, to a stationary patient lifting device especially adapted to lift a patient out of bed and into a chair and later back into bed.

2. Description of the Prior Art

Patient lifting devices are known in the art of hospital equipment (for some examples, see U.S. Pat. Nos. 4,649,581; and 5,068,931). The prior art patient lifting devices are typically portable apparatuses intended for use in hospitals where they can be moved around from one patient's room to another.

Thus, while the foregoing body of prior art indicates it to be known to use portable devices for lifting patients in hospitals, the provision of a simple and cost effective device for use in a patient's home is not contemplated. Nor does the prior art described above teach or suggest a permanently positioned device which may be used by individuals in their own homes to take care of their relatives. The foregoing disadvantages are overcome by the unique stationary patient lift of the present invention as will be made apparent from the following description thereof. Other advantages of the present invention over the prior art also will be rendered evident.

SUMMARY OF THE INVENTION

To achieve the foregoing and other advantages, the present invention, briefly described, provides a stationary patient lift which can be used by individuals in their own homes to lift disabled and elderly individuals living with them. The lift has an electric hoist/wench for lifting the patients from a bed to a chair or wheelchair and back again to the bed. The lift is fixed to the rafters of a house and the cable hangs down through the ceiling of the house. The electric hoist hangs from the cable just below the ceiling. A chain or strap or series of straps hangs down from the hoist mechanism to a sling for supporting the patient.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining the preferred embodiments of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new stationary patient lift which has all of the advantages of the prior art and none of the disadvantages.

It is another object of the present invention to provide a new stationary patient lift which may be easily and efficiently manufactured and marketed.

It is a further objective of the present invention to provide a new stationary patient lift which is of durable and reliable construction.

An even further object of the present invention is to provide a new stationary patient lift which is susceptible of a low cost of manufacture with regard to both materials and labor, and which accordingly is then susceptible of low prices of sale to the consuming public, thereby making such stationary patient lift available to the buying public.

Still yet a further object of the present invention is to provide a new stationary patient lift which can be permanently attached to the roof structure of a house from which the device can hang down to a position from which a patient can be lifted up from a bed and then lowered to a chair or wheelchair and then later lifted from the chair or wheelchair and lowered back into the bed.

It is still a further object of the present invention to provide a new stationary patient lift which can be used by anyone, regardless of their strength, to lift a relative back and forth from bed to chair.

Still a further object of the present invention is to provide a new stationary patient lift including means for controlling the lifting and lowering actions of the lift device.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein:

FIG. 3 is a cross-sectional view of a power box for use in the stationary patient lift of FIGS. 1 and 2 in accordance with the present invention.

FIG. 4 is a perspective view of a sling which can be used as part of the stationary patient lift of FIGS. 1–3 in accordance with the present invention.

DESCRIPTION OF THE PREFERRED EMBODIMENT

Figure 1:
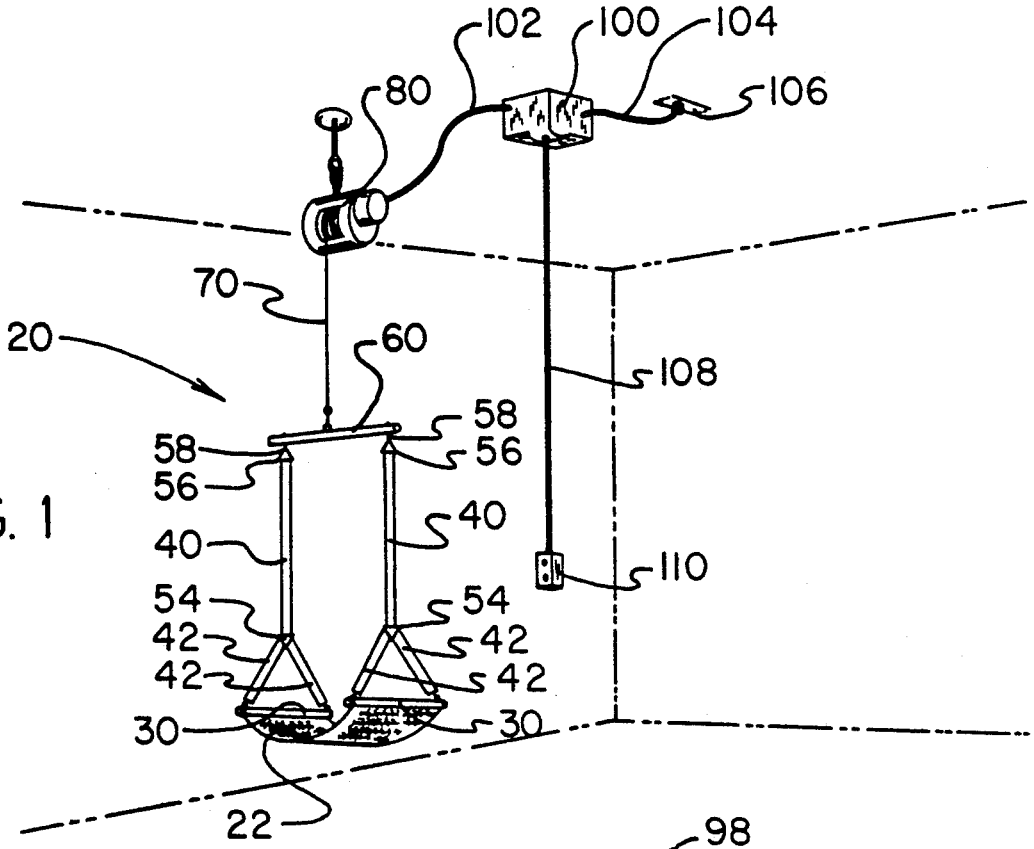
FIG. 1 is a perspective view showing the first preferred embodiment of the stationary patient lift of the invention.
Figure 2:
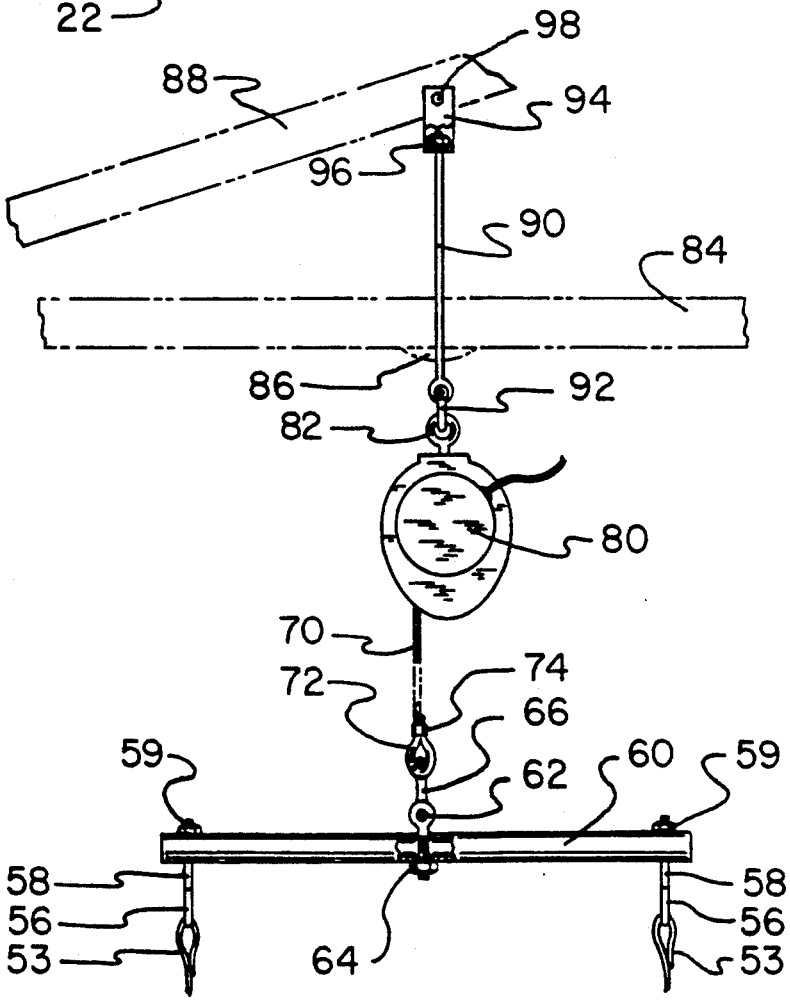
FIG. 2 is a perspective view in closer detail of a lifting mechanism for the stationary patient lift of FIG. 1 in accordance with the present invention.

With reference now to the drawings, a new stationary patient lift embodying the principles and concepts of the present invention will be described.

Turning initially to FIGS. 1–4, there is shown a first exemplary embodiment of the stationary patient lift of the present invention generally designated by reference numeral 20. In its preferred form, stationary patient lift 20 is installed in an individual's home so that they can move disabled and elderly individuals from a bed to a chair or wheelchair and then later back into bed. The lift 20 comprises generally a sling 22 which is lifted by means of a winch 80 which is supported by the roof rafters 88 of the house.

The details of the preferred embodiment of the sling 22 are best seen in FIGS. 1 and 4. The sling 22 itself can be made out of any suitable material such as, but not limited to, leather, canvas and the like. At both ends of the sling 22, a part 24 of the sling 22 is wrapped around a bar 30. The end of the sling material overlaps to form a reinforced loop part 26 of the sling 22 to hold each side of the sling to a bar 30. Reinforcing sewn rivets 28 are used to keep the overlapping loop section 26 of material secure. Each of the two bars 30 hangs from a set of sling corner support straps 42 by means of ring screws 32 secured by nuts 34. Clip hooks 44 are secured to the bottom of each of the sling 22 corner support straps 42 by means of small support rods 46 held in an overlapping sewn loop reinforcement section 48. The clip hooks 44 are hooked to ring screws 32 to support the sling 22.

The four sling corner support straps 42 are attached by means of lower triangle rings 54 to two main support straps 40 (the two straps 42 at each end of the sling 22 are supported by one strap 40 at each end).

Reinforced overlap loop areas 50 at the top of the straps 42 and reinforced overlap areas 52 at the bottom of straps 40 are fixed to lower triangle rings 54. Each strap 40 has at its top a reinforcement loop 53 which is hooked to upper triangle rings 56.

The upper triangle rings 56 have end threaded support pins 58 extending away. Nuts 59 are used for holding the threaded support pins 58 to a single support bar 60. A ring screw 62 passes through a hole in the support bar 60 and is fixed in place by a nut 64. A ring 66 passes through the ring screw 62 and also through the a hole in the reinforced loop section 72 of a lifting cable 70. A reinforcement piece 74 fixes the loop section 72 together.

An electrically powered hoist or winch mechanism 80 hangs from the roof rafters 88 by means of a hook 82 integrally fixed above the winch 80. A winch support rod 90 hangs from the rafters 88 through the ceiling 84 to a hook 92 at the bottom of winch support rod 90. The hook 92 of the support rod 90 is hooked to the hook 82 of the winch 80. A cover plate 86 can be placed around the support rod 90 underneath the ceiling 84 to provide an attractive appearance and to give the support rod 90 some added stability.

The support rod 90 is mounted to the rafter 88 by means of a bracket 94. The support rod 90 is threaded at its top and a nut 96 holds the rod 90 to the bracket 94. The bracket 94 is bolted to the rafter by means of a bolt 98.

As can be seen more clearly in FIG. 3, the lifting device is powered by electricity from a standard electrical socket 106, the AC current running through AC power cord 104 to power box 100. Power box 100 is housed in power box housing 120. AC current from the power cord 104 is sent to AC/DC transformer 126 which transforms the electricity from AC to DC. The DC goes through a circuit protector 128 which protects the circuitry of the device and which contains the switching mechanism for switching the equipment on and off based on signals from a hand control switch box 110. The hand control switch box 110 hangs down from the housing 120 by means of a control switch cord 108 to a level an individual can reach. A reel 130 enables the level of the switch box 110 to move up or down as desired by the user. When the device is switched on, direct current is sent through DC power cord 102 to the wench motor allowing the wench to be able to lift or lower a patient. Support plug 124 for cord 102 and support plug 124 for cord 104 can be positioned on the housing 120 to support the respective electrical cords.

The power box 100 is mounted on ceiling support beams 134 by means of screws 132.

Use of the patient lifting device of the present invention is very easy. When it is necessary to move a patient from a bed to a chair or wheelchair, the sling 22 is slid under the patient and the power is turned on. The up switch is activated and the device lifts the patient out of bed. A chair or wheelchair is then placed under the patient and the lowering switch is activated. The patient is then lowered into the chair or wheelchair. The device is then turned off. When it is desired to return the patient to bed, the sling 22 is again slid under the patient and the device is turned on. The lift switch is activated and the patient will be lifted out of the chair or wheelchair. The bed is then rolled under the sling 22 and the lowering switch is activated, lowering the patient into the bed. The device can then be turned off.

Figure 5:
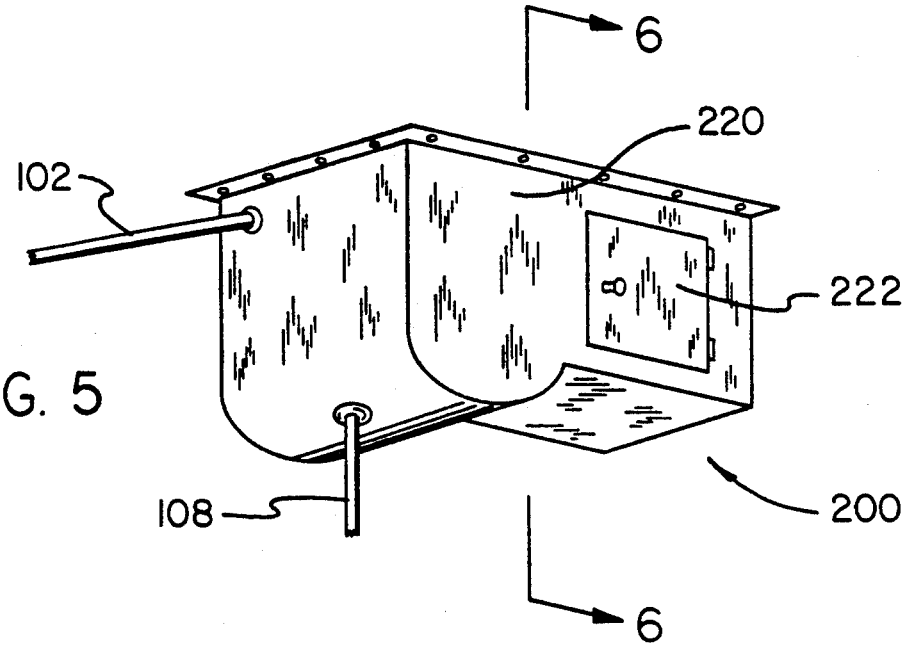
FIG. 5 is a perspective view of an alternative power box for use in a stationary patient lift in accordance with the present invention.
Figure 6:
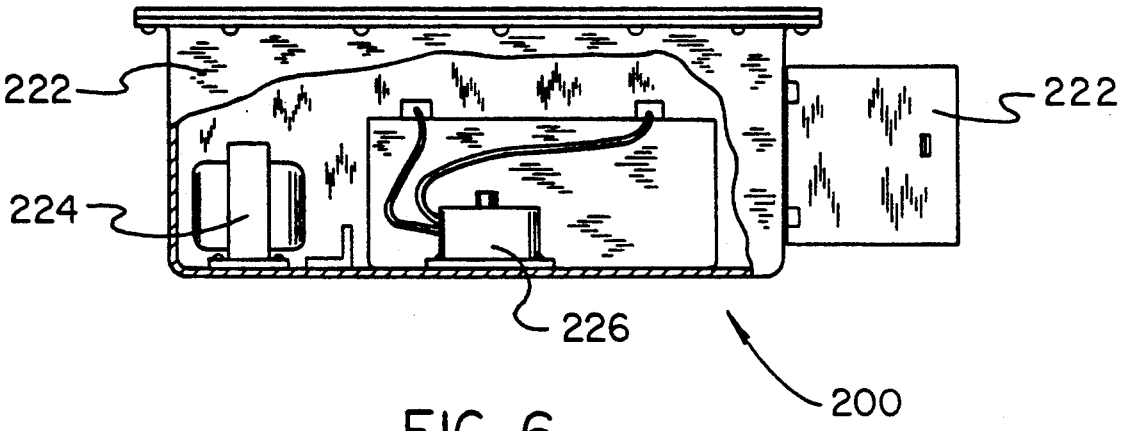
FIG. 6 is a perspective view of the alternative power box of FIG. 5 for use in a stationary patient lift shown partially cut away in accordance with the present invention.

An alternative embodiment power box 200 having emergency battery backup power for power outages is shown in FIGS. 5 and 6. The alternative power box 200 is housed in a housing 220 having an access door 222. A battery 224 can be electrically connected to a switching device 226 which activates the battery power when needed during an electrical power outage. Use of the alternative power box is the same as in the initial preferred embodiment. The only difference is that during a power outage, the switching device 226 will automatically activate battery power.

Figure 7:
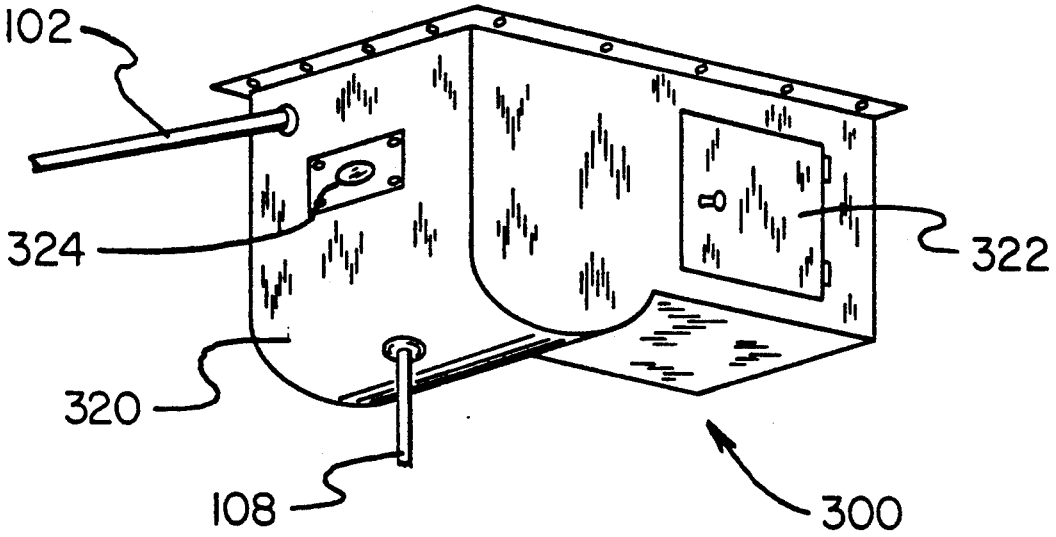
FIG. 7 is a perspective view of another alternative power box for use in a stationary patient lift in accordance with the present invention.
Figure 8:
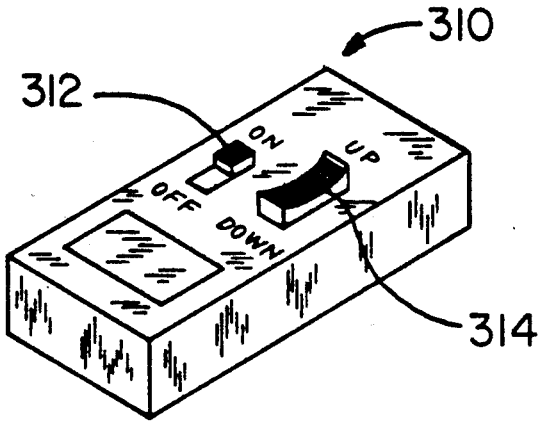
FIG. 8 is a perspective view of a wireless remote control which can be used with the alternative power box of FIG. 7 for use in a stationary patient lift in accordance with the present invention.

Another alternative embodiment power box 300 having a hand held wireless remote controller 310 is shown in FIGS. 7 and 8. The hand held remote controller has an on/off switch 312 and an up/down switch 314. The housing 320 of the power box 300 has an access door 322 and a receiver eye 324 for receiving the remote controller's signal. Use of this alternative power box is the same as the initial preferred embodiment except that the hanging controller box 110 is replaced with a wireless controller 310.

It is apparent from the above that the present invention accomplishes all of the objectives set forth by providing a new lift for patients comprising: a patient holding means; a means for supporting the patient holding means from above, the means for supporting permanently fixable to a stationary and permanent structure; a means for raising and lowering the patient; and a means for activating the raising and lowering of the patient; whereby the lift can be permanently mounted in a building and a patient can be lifted into and out of bed using the lift. The patient holding means can be a supported sling. The means for raising and lowering the patient can be a wench. The means for activating can be a hand held controller, which can be wireless. The lift can be powered by alternating current provided from a standard electrical outlet socket. The lift can have alternate DC battery power for use during alternating current power outages.

With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as encompass all such modifications and equivalents.

What is claimed as being new and desired to be protected by Letters Patent of the United States is as follows:

1. A new stationary lift for patients comprising:

a patient holding means;

a means for supporting said patient holding means from above, said means for supporting permanently fixable to a stationary and permanent structure;

a means for raising and lowering the patient comprising a winch affixed to a ceiling of said stationary and permanent structure, said winch further including cable means, and further including support means extending through said ceiling and being connected at one end to said winch and being connected at another opposed end to a roof rafter above said ceiling; and a means for activating the raising and lowering of the patient;

whereby the lift is permanently mounted in a building and a patient can be lifted into and out of bed using the lift, wherein said patient holding means comprises a sling having first and second opposed ends, wherein said means for supporting said sling from above comprises a support bar, said support bar extending parallel to the longitudinal axis of said sling and being connected to said means for raising and lowering said patient, said support bar being further connected to first and second support straps at opposite ends thereof respectively, said first support strap being connected to a first pair of sling support straps each one of said pair being connected to a corresponding opposed end of a first sling support bar extending orthogonally with respect one end of said sling and said longitudinal axis of said sling support bar, said first sling support bar being connected to said one end of said sling, said second support strap being connected to a second pair of sling support straps each one of said pair being connected to a corresponding opposed end of a second sling support bar extending orthogonally with respect said other opposed end of said sling and said longitudinal axis of said sling support bar, said second sling support bar being connected to said another opposed end of said sling, such that said first and second pairs of sling support straps form triangular connections between said first support strap and said first sling support bar, and between said second support strap and said second sling support bar, respectively.

2. The invention of claim 1 wherein said means for activating is a hand held controller.

3. The invention of claim 2 wherein said hand held controller is wireless.

4. The invention of claim 1 wherein said lift is powered by alternating current provided from a standard electrical outlet socket.

5. The invention of claim 4 wherein said lift has alternate DC battery power for use during alternating current power outages.

6. The new stationary patient lift of claim 1 further comprising:

releasable hook means attached to said first and second pairs of sling support straps for connection to corresponding eyelet means attached to the ends of said first and second sling support bars, respectively.

* * * * *